US009302817B2

(12) United States Patent
Petkovsek

(10) Patent No.: US 9,302,817 B2
(45) Date of Patent: Apr. 5, 2016

(54) SELF-MAILER AND/OR METHOD FOR MAILING CORRESPONDENCE AND/OR ARTICLES VIA A SPECIAL SERVICE

(76) Inventor: Glenn Petkovsek, Vero Beach, FL (US)

( * ) Notice: Subject to any disclaimer, the term of this patent is extended or adjusted under 35 U.S.C. 154(b) by 823 days.

(21) Appl. No.: 12/928,512

(22) Filed: Dec. 14, 2010

(65) Prior Publication Data

US 2012/0145773 A1 Jun. 14, 2012

(51) Int. Cl.
*B65D 27/04* (2006.01)
*B42D 15/08* (2006.01)

(52) U.S. Cl.
CPC ..... *B65D 27/04* (2013.01); *B42D 15/08* (2013.01)

(58) Field of Classification Search
CPC ..... B65D 27/04; B65D 27/06; B42D 15/08; B42D 15/006; B42D 5/025; B42D 5/026
USPC ..... 229/70, 71, 75, 307, 313, 316
See application file for complete search history.

(56) References Cited

U.S. PATENT DOCUMENTS 2,204,690 A * 6/1940 Nuyts ..... 229/314
4,093,117 A * 6/1978 Morse ..... 229/70
4,598,860 A * 7/1986 Pennock ..... 229/69
5,316,208 A 5/1994 Pekovsek
5,340,017 A * 8/1994 Tighe ..... 229/300
5,411,201 A 5/1995 Pekovsek
5,507,526 A 4/1996 Pekovsek
5,560,185 A 10/1996 Pekovsek
5,573,277 A 11/1996 Pekovsek
5,626,286 A 5/1997 Pekovsek
5,626,370 A 5/1997 Pekovsek
5,697,648 A 12/1997 Pekovsek
5,746,450 A 5/1998 Pekovsek
5,848,809 A 12/1998 Pekovsek
5,860,904 A 1/1999 Pekovsek
5,862,978 A * 1/1999 Forrest ..... 229/70
5,887,904 A 3/1999 Pekovsek
5,890,647 A 4/1999 Pekovsek
5,915,730 A 6/1999 Pekovsek
5,918,802 A 7/1999 Pekovsek
5,950,910 A 9/1999 Pekovsek
5,951,053 A 9/1999 Pekovsek
5,967,558 A 10/1999 Pekovsek
5,970,458 A 10/1999 Pekovsek
5,984,365 A 11/1999 Pekovsek
6,003,902 A 12/1999 Pekovsek
6,041,999 A 3/2000 Pekovsek
6,047,880 A 4/2000 Pekovsek
6,050,603 A 4/2000 Pekovsek
6,071,367 A 6/2000 Pekovsek
6,089,613 A 7/2000 Pekovsek
6,120,063 A 9/2000 Pekovsek
6,136,129 A 10/2000 Pekovsek
6,145,884 A 11/2000 Pekovsek
6,179,334 B1 1/2001 Pekovsek
6,203,068 B1 3/2001 Pekovsek (Continued)

*Primary Examiner* — J. Gregory Pickett
*Assistant Examiner* — Peter Helvey
(74) *Attorney, Agent, or Firm* — Patents+TMS, P.C.

(57) ABSTRACT

A self-mailer and a method receive correspondence and articles for mailing and/or delivery via a special service. The self-mailer is foldable and has an interior portion that provides space for printing a communication thereon. The self-mailer has a printable and detachable portion that is removed before folding, assembly and sealing the self-mailer. The interior portion of the self-mailer has a pocket for holding and/or mailing documents, envelopes, forms, checks and/or the like via the special service.

13 Claims, 11 Drawing Sheets

(56) References Cited

U.S. PATENT DOCUMENTS

| | | | | |
|---|---|---|---|---|
| 6,241,844 | B1 | 6/2001 | Pekovsek | |
| 6,290,262 | B1 | 9/2001 | Pekovsek | |
| 6,361,077 | B1 | 3/2002 | Pekovsek | |
| 6,371,521 | B1 | 4/2002 | Pekovsek | |
| 6,388,764 | B2 | 5/2002 | Pekovsek | |
| 6,400,829 | B1 | 6/2002 | Pekovsek | |
| 6,676,794 | B1 | 1/2004 | Pekovsek | |
| 6,863,310 | B1 | 3/2005 | Pekovsek | |
| 6,918,615 | B2 | 7/2005 | Pekovsek | |
| 6,929,401 | B2 * | 8/2005 | Matusewicz | 383/113 |
| 6,962,371 | B1 | 11/2005 | Pekovsek | |
| 7,213,844 | B2 * | 5/2007 | Malette et al. | 283/116 |
| 7,350,820 | B1 | 4/2008 | Pekovsek | |
| 7,493,292 | B2 | 2/2009 | Pekovsek | |
| 2001/0032872 | A1 * | 10/2001 | Guest | 229/80 |
| 2006/0113367 | A1 * | 6/2006 | Emmott | 229/313 |

* cited by examiner

2

SELF-MAILER AND/OR METHOD FOR MAILING CORRESPONDENCE AND/OR ARTICLES VIA A SPECIAL SERVICE

BACKGROUND OF THE INVENTION

The present invention generally relates to a self-mailer and/or a method for mailing correspondence and/or articles via a special service, such as, for example, priority mail, certified mail, critical mail and/or the like. More specifically, the present invention relates to a foldable self-mailer that may have an interior portion that may provide space for printing a communication thereon prior to folding, assembling and/or sealing the self-mailer for deposit with a postal carrier or a parcel carrier. The interior portion of the self-mailer may have a pocket that may be used, if needed, for holding and/or mailing documents, envelopes, forms, checks and/or the like via the special service.

It is, of course, generally known to mail correspondence and/or articles requiring special services for delivery of the article, such as certified mail, registered mail, priority mail, first class mail, critical mail, insured mail, COD, return receipt for merchandise and/or the like. For example, the U.S. Postal Service provides certified mail service and registered mail service for priority mail and for first class mail. For certified mail, the U.S. Postal Service provides both proof of deposit, proof of delivery, and online tracking using a tracking number or a unique article ID. For certified mail, the U.S. Postal Service obtains a signature of the recipient at the time of delivery which the U.S. Postal Service electronically stores in U.S. Postal Service records and which may be retrieved by the sender. Registered mail may be used for highly valuable and/or irreplaceable items. For registered mail, the U.S. Postal Service transports the mail separately from other mail in locked containers. Registered mail includes tracking services and insurance is available for the items being transported. The U.S. Postal Service has proposed critical mail as an affordable special service alternative to priority mail. As proposed, critical mail service also provides proof of deposit, proof of delivery, recipient signature confirmation and online tracking using the tracking number and/or the unique article ID.

Known components and methods for assembling a mailer for mailing correspondence and/or articles requiring special services have multiple, separate components requiring attachment to an exterior of an envelope for the special services delivery of the correspondence and/or the articles.

A postal employee typically receives an envelope from a customer for mailing the correspondence and/or the articles via the special service. The postal employee then requires the customer to attach or otherwise provide the envelope with a permanent seal or label indicating that the envelope requires delivery and/or tracking by the special service. The postal employee must ensure that all appropriate labels and documents are both stocked and available for use and are completed and affixed to the envelope prior to delivery of the article. Such a procedure is both complex and time-consuming, as well as labor intensive. Further, the procedure may be confusing to the customer mailing the correspondence.

Further, neither the existing special service envelopes nor the procedure allows the customer to print correspondence directly upon an interior of the special service mailing envelope. The procedure requires that the customer provides the correspondence on separate paper for insertion within the special service envelope which may create unnecessary waste. Moreover, the procedure may be time consuming for customers who are mailing mass quantities of correspondence and/or articles via special services. Of course, it should be understood that an envelope being prepared for mailing by special services may be prepared by any individual, not just a postal employee. Additionally, the envelope may be prepared by the individual in advance of the time of deposit with the postal carrier. Preparing an envelope for mailing by special services prior to deposit with the postal employee saves time for both the customer and the postal employee.

A need, therefore, exists for a self-mailer and/or a method for mailing correspondence and/or articles via a special service, such as, for example, priority mail, certified mail, critical mail and/or the like. Further, a need exists for a self-mailer and/or a method that may allow a customer to print correspondence, addresses, postage and/or the like directly on the self-mailer prior to assembly, sealing and deposit with the postal carrier. Still further, a need exists for a self-mailer and/or a method that may have a pocket that may be used, if needed, to mail articles, such as, for example, papers, documents, checks, forms and/or the like via the special service. Still further, a need exists for a self-mailer and/or a method that may be permanently sealed prior to mailing via the special service. Still further, a need exists for a self-mailer and/or a method that may be intuitive and easy to use by a customer requiring a special services mailing assembly. Still further, a need exists for a self-mailer and/or a method that may not require special equipment, such as, for example, a folder, a sealer and/or the like to prepare the self-mailer for mailing. Still further, a need exists for a self-mailer and/or a method that may be assembled for mailing at, for example, one desk or one workstation. Still further, a need exists for a self-mailer and/or a method that may be intuitive and easy to open by a recipient.

SUMMARY OF THE INVENTION

The present invention generally relates to a self-mailer and/or a method for mailing correspondence and/or articles via a special service, such as, for example, priority mail, certified mail, critical mail and/or the like. More specifically, the present invention relates to a foldable self-mailer that may have an interior portion that may provide space for printing a communication. The interior portion of the self-mailer may have a pocket for holding documents, envelopes, forms, checks, tickets and/or the like.

The self-mailer may have a detachable portion at a first end of the self-mailer. The detachable portion may have removable adhesive labels, such as, for example, an addressee label, a return-address, a special service label, a postage label, a receipt and/or the like to effect and/or to track delivery via the special service. The self-mailer may be customized prior to mailing using simplex and/or duplex printing methods. Further, an outside of the self-mailer may allow for static and/or variable printing of information, such as, for example, a send-to address, pre-print static information and/or the like. After preparing the correspondence for mailing, the detachable portion may be removed and/or the self-mailer may be folded. The self-mailer may be permanently sealed to itself to obscure the communication and/or to secure the pocket before mailing. The removable adhesive label or labels may be removed from the detachable portion and affixed to an exterior portion of the self-mailer to effect delivery. Alternatively, information, such as, for example, a delivery address, a return address, a special services tracking number, a unique article number, a special service bar code, postage and/or the like may be printed on the mailer before and/or after final assembly for deposit with the postal carrier.

To this end, in an embodiment of the present invention, a self-mailer for delivery via a special service is provided. The self-mailer has a generally rectangular sheet having a width defined between a front side and a rear side wherein the rear side is positioned opposite to the front side wherein the sheet has a height defined between a top end and a bottom end wherein the bottom end is positioned opposite to the top end wherein the sheet has a length defined between a first end and a second end wherein the second end is positioned opposite to the first end wherein the sheet is divided into a top panel and a bottom panel by a fold line that extends between the first end of the sheet and the second end of the sheet wherein the front side has indicia indicative of the special service. Further, the self-mailer has a detachable portion at the first end of the sheet wherein the detachable portion extends between the top end of the sheet and the bottom end of the sheet. Still further, the self-mailer has a first separation strip at the second end of the sheet wherein the first separation strip extends between the top end of the sheet and the bottom end of the sheet. Moreover, the self-mailer has an adhesive on the first separation strip on the rear side of the sheet and at the bottom end on the rear side of the sheet wherein the rear side of the top panel is attachable to the rear side of the bottom panel with the adhesive.

In an embodiment, the self-mailer has a separation line between the detachable portion and the first end of the sheet wherein the detachable portion is removable from the first end of the sheet at the separation line.

In an embodiment, the self-mailer has a separation line between the first separation strip and the second end of the sheet wherein the first separation strip is removable from the second end of the sheet at the separation line.

In an embodiment, the self-mailer has a tab extending from the bottom panel at the first end between the detachable portion and the bottom panel wherein the tab is attachable to the top panel on the front side.

In an embodiment, the indicia is an article number for tracking delivery via the special service.

In an embodiment, the self-mailer has a second separation strip at the first end of the sheet wherein the second separation strip extends between the top end of the sheet and the bottom end of the sheet wherein the second separation strip is positioned between the detachable portion, the top panel and the bottom panel.

In an embodiment, the self-mailer has a flap attached to the rear side of the sheet to form a pocket between the flap and the rear side of the sheet.

In an embodiment, the self-mailer has an adhesive label on the detachable portion wherein the adhesive label is removable from the detachable portion.

In an embodiment, the self-mailer has a liner on the adhesive wherein the liner is removable from the adhesive.

In an embodiment, the sheet is a laminated paper product.

In an embodiment, the adhesive provides a bond between the top panel of the sheet and the bottom panel of the sheet.

In an embodiment, the adhesive is applied in a pattern to the sheet to form a discontinuous layer of the adhesive between the first end and the second end.

In an embodiment, the self-mailer has a release layer on the detachable portion wherein the release layer is a silicon coating.

In another embodiment, a mailer for mailing correspondence requiring delivery by a special service wherein delivery by the special service requires a display of indicia related to delivery by the special service on an outside surface of the mailer is provided. The mailer has a postal form having a first end and a second end wherein the second end is positioned opposite to the first end wherein the postal form has a first side and a second side wherein the second side is positioned opposite to the first side wherein the correspondence and the indicia related to the delivery by the special service are displayable on the second side of the postal form wherein the postal form has a top panel and a bottom panel divided by a fold line wherein the postal form folds at the fold line to position the second side of the top panel substantially adjacent to the second side of the bottom panel. Further, the mailer has a blank area on the second side of the postal form to display the correspondence. Still further, the mailer has a detachable portion extending from the top panel and the bottom panel. Still further, the mailer has adhesive labels on the detachable portion on the second side of the postal form wherein the adhesive labels are removable from the second side of the postal form for attachment to the first side of the postal form. Still further, the mailer has an adhesive on the second side of the postal form to affix the bottom panel to the top panel. Moreover, the mailer has a separation line on the postal form at the first end and the second end to open the postal form.

In an embodiment, the mailer has a pocket on the second side of the postal form.

In an embodiment, the separation line is a linear perforation.

In another embodiment, a method for preparing a mailer for a delivery of correspondence by a special service wherein the delivery of the correspondence by the special service requires indicia associated with the special service viewable on the mailer is provided. The method has the step of providing a mailer having an inside and an outside, a top panel and a bottom panel divided by a fold line, an adhesive to adhere the top panel to the bottom panel, a detachable portion with labels and a pocket on the inside of the mailer. Further, the method has the step of displaying the indicia associated with the special service on the labels. Still further, the method has the step of removing the detachable portion from the mailer. Still further, the method has the step of folding the first panel at the fold line to a position substantially adjacent to the second panel. Still further, the method has the step of adhering the first panel to the second panel. Still further, the method has the step of removing the labels from the detachable portion. Moreover, the method has the step of attaching the labels to the outside of the mailer.

In an embodiment, the method has the step of bending the mailer to open the pocket.

In an embodiment, the method has the step of inserting the correspondence into the pocket.

In an embodiment, the method has the step of displaying the correspondence on the inside of the mailer.

It is, therefore, an advantage of the present invention to provide a self-mailer and/or a method for mailing correspondence and/or articles via a special service.

Another advantage of the present invention is to provide a self-mailer and/or a method for mailing correspondence and/or articles via a special service, such as, for example, priority mail, certified mail, critical mail and/or the like.

And, another advantage of the present invention is to provide a self-mailer and/or a method for mailing correspondence and/or articles via a special service that may have an interior portion that may provide space for printing a communication thereon prior to folding, assembling and/or sealing the self-mailer for deposit with a postal carrier and/or a delivery person.

Yet another advantage of the present invention is to provide a self-mailer and/or a method for mailing correspondence and/or articles via a special service wherein the interior portion of the self-mailer may have a pocket that may be used for holding and/or mailing documents, envelopes, forms, checks, tickets and/or the like via the special service.

A further advantage of the present invention is to provide a self-mailer and/or a method for mailing correspondence and/or articles via a special service that may allow a customer to print correspondence, addresses, postage, fees and/or the like directly on the self-mailer prior to assembly, sealing and deposit with a postal carrier and/or the delivery person.

Moreover, an advantage of the present invention is to provide a self-mailer and/or a method for mailing correspondence and/or articles via a special service that may be sealed prior to mailing via the special service.

And, another advantage of the present invention is to provide a self-mailer and/or a method for mailing correspondence and/or articles via a special service that may be intuitive and easy to use by a customer requiring a special services mailing assembly or special equipment.

Yet another advantage of the present invention is to provide a self-mailer and/or a method for mailing correspondence and/or articles via a special service that may be intuitive and easy to open by a recipient.

Another advantage of the present invention is to provide a self-mailer and/or a method for mailing correspondence and/or articles via a special service that may have a detachable portion.

Yet another advantage of the present invention is to provide a self-mailer and/or a method for mailing correspondence and/or articles via a special service wherein the detachable portion may have removable adhesive labels, such as, for example, an addressee label, a return address label, a special service label, a unique article number label, a bar code label, a tracking number label, a postage label, a receipt and/or the like to effect and/or to track delivery via the special service.

A still further advantage of the present invention is to provide a self-mailer and/or a method for mailing correspondence and/or articles via a special service that may be customized prior to mailing using simplex and/or duplex printing methods.

Moreover, an advantage of the present invention is to provide a self-mailer and/or a method for mailing correspondence and/or articles via a special service wherein one or more of the removable adhesive labels may be removed from the detachable portion and affixed to the self-mailer to effect delivery.

And, another advantage of the present invention is to provide a self-mailer and/or a method for mailing correspondence and/or articles via a special service wherein information, such as, for example, a delivery address, a return address, a special services tracking number, a special service bar code, postage and/or the like may be printed on the mailer before and/or after final assembly for deposit with the postal carrier and/or delivery person.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a self-mailer and/or a method for mailing correspondence and/or articles via a special service, such as, for example, certified mail, registered mail, priority mail, first class mail, critical mail, insured mail, COD, return receipt for merchandise and/or the like. The present invention may be manufactured to meet the U.S. Postal Service standards for the special service selected by the sender, including, but not limited to, certified mail, registered mail, priority mail, first class mail, critical mail, insured mail, COD, return receipt for merchandise and/or the like. Further, the present invention may be utilized by other delivery-type services. The present invention should not be deemed as limited to a specific special service, postal service and/or delivery service. It should be understood that the special service may be any special service provided by a postal carrier, delivery carrier and/or a parcel carrier as known to one having ordinary skill in the art.

Figure 1:
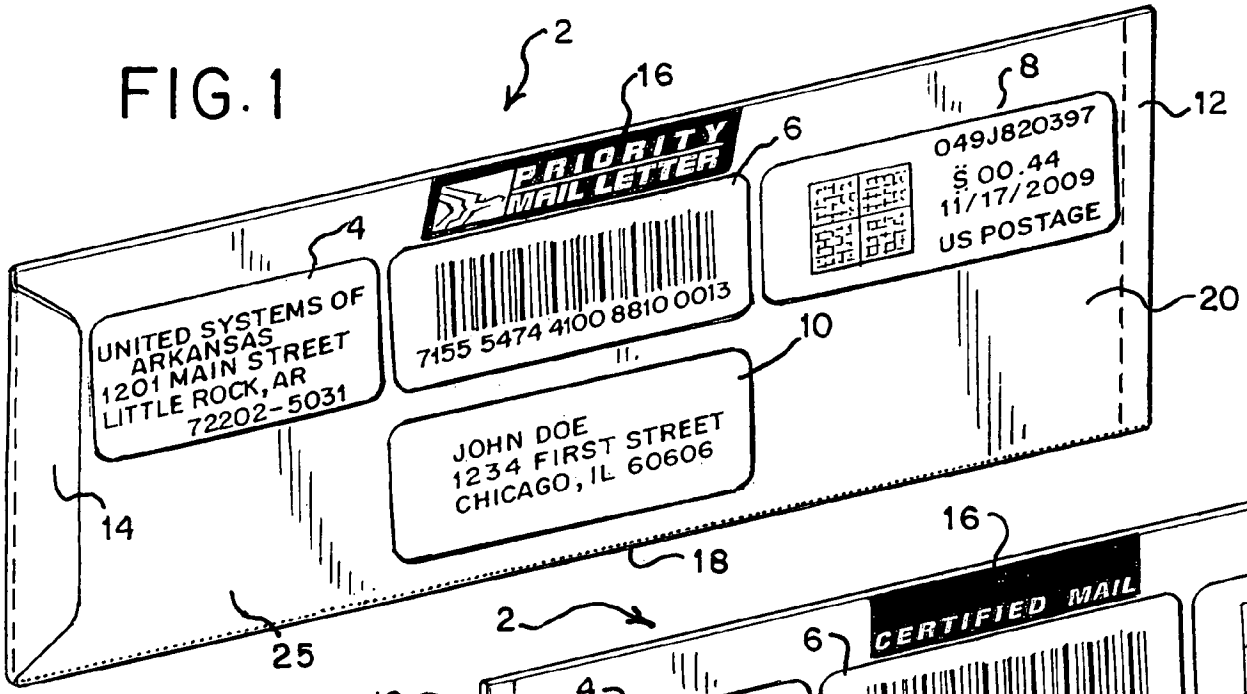
FIG. 1 illustrates a perspective view of an assembled self-mailer for mailing correspondence and/or articles via a special service in an embodiment of the present invention.
Figure 2:
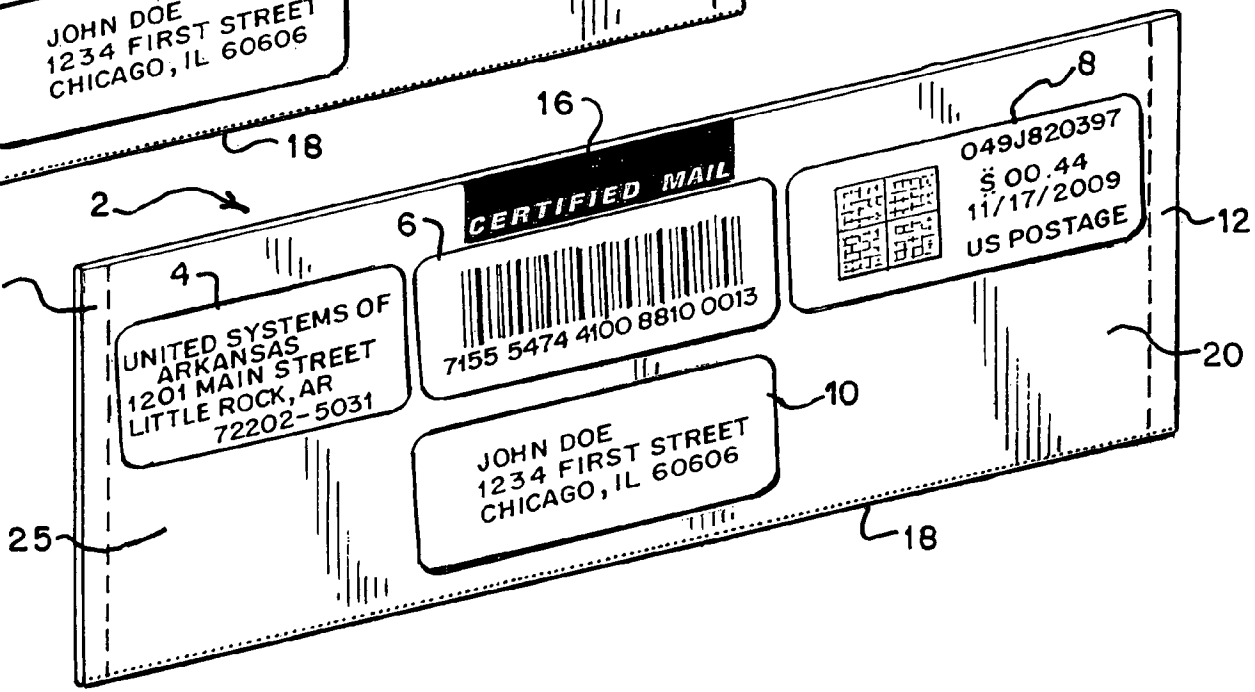
FIG. 2 illustrates a perspective view of an assembled self-mailer for mailing correspondence and/or articles via a special service in an embodiment of the present invention.
Figure 5:
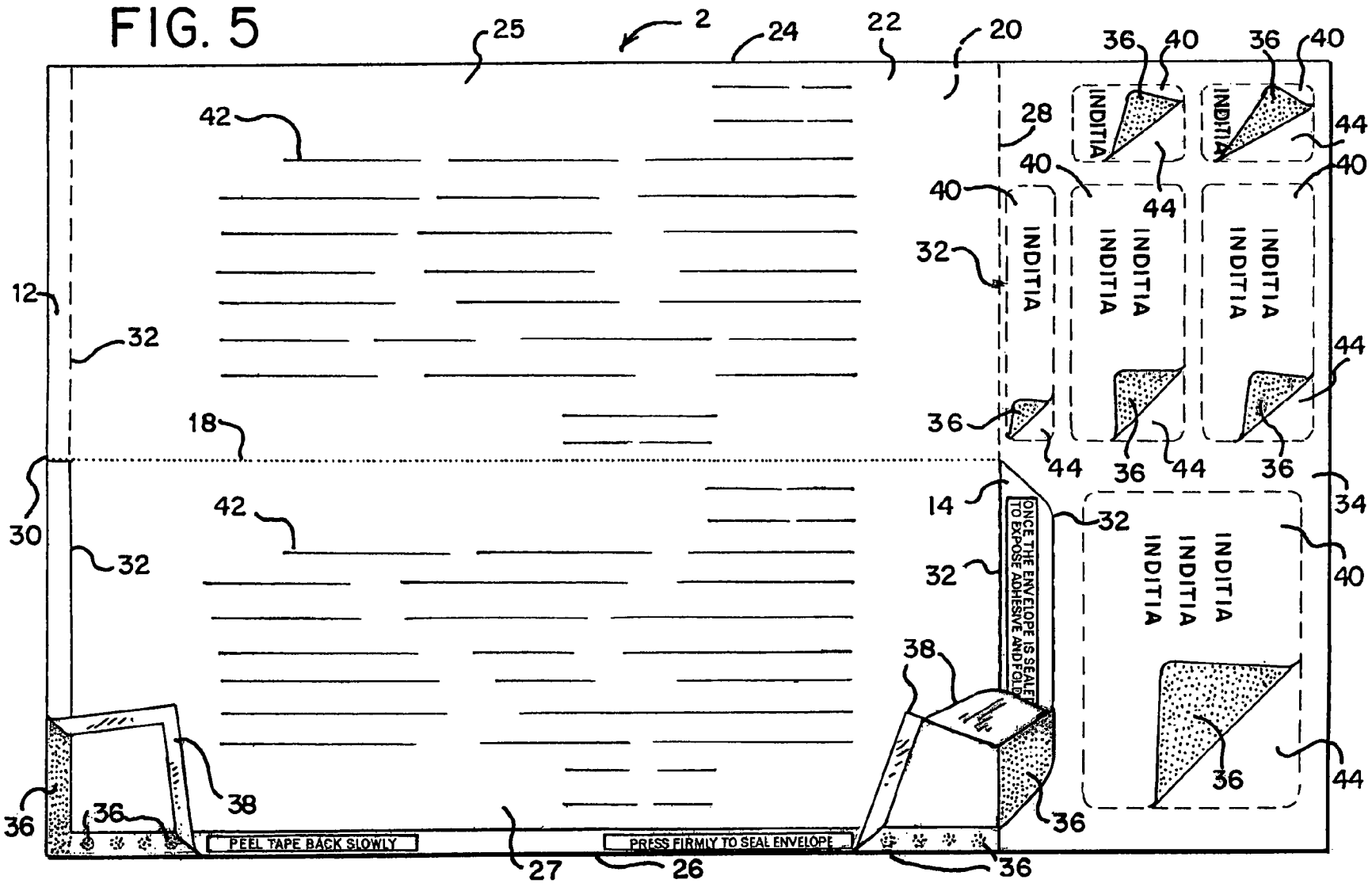
FIG. 5 illustrates a rear plan view of a self-mailer for mailing correspondence and/or articles via a special service in an embodiment of the present invention.
Figure 6:
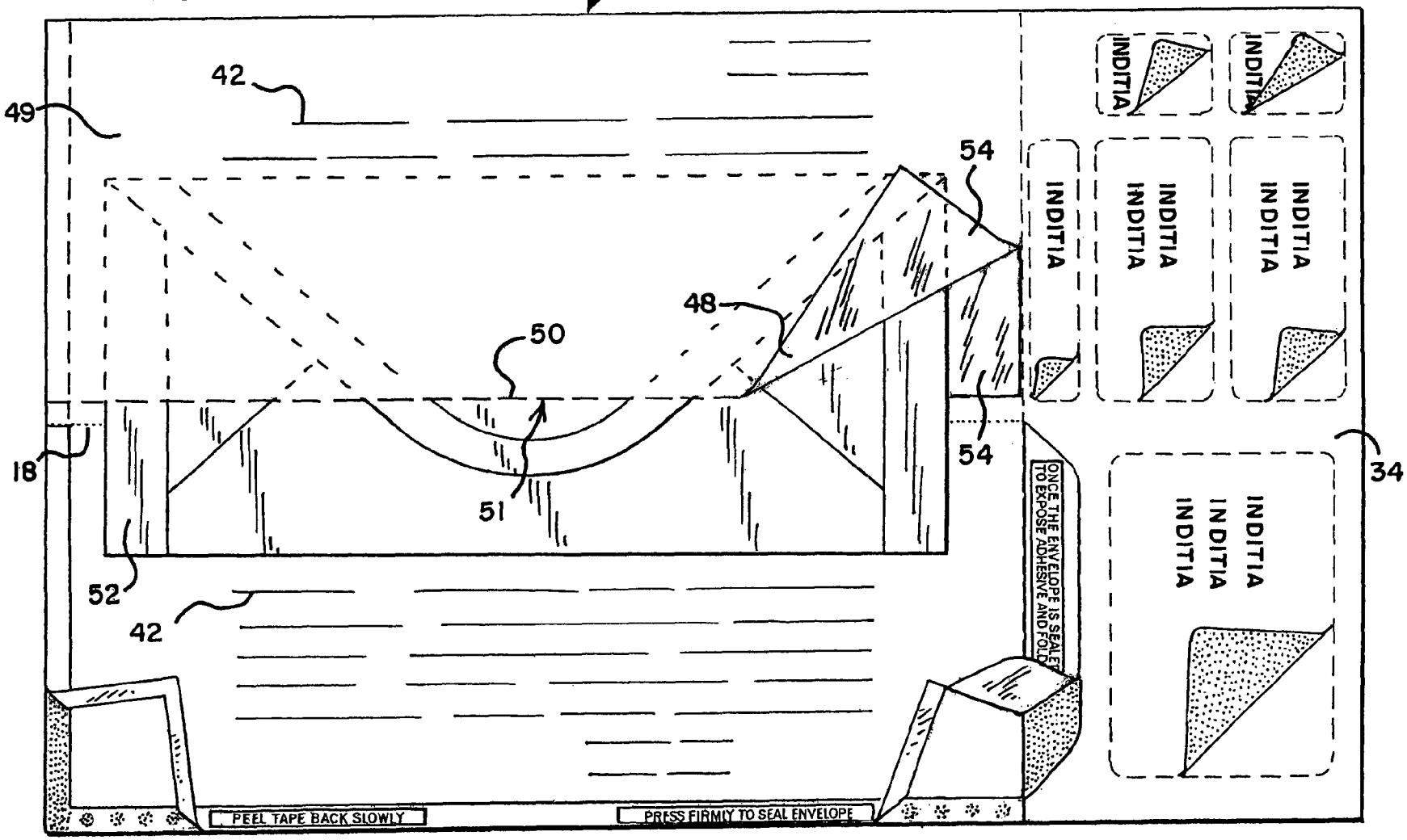
FIG. 6 illustrates a rear plan view of a self-mailer for mailing correspondence and/or articles via a special service in an embodiment of the present invention.

Referring now to the drawings wherein like numerals refer to like parts, FIGS. 1 and 2 illustrate a self-mailer 2 assembled for delivery by the special service in embodiments of the present invention. As shown in FIGS. 5 and 6, the self-mailer may be used for mailing correspondence 42 and/or an article 52 via the special service. As shown in FIGS. 5 and 6, the correspondence 42 may be printed, typed and/or handwritten on the self-mailer 2 before assembling the self-mailer 2 for delivery by the special service. The self-mailer 2 may be configured to receive, for example, a communication printed, typed and/or handwritten on one side of the mailer. The communication may be printed, typed and/or handwritten directly on the self-mailer 2. The communication may be, for example, up to a one page correspondence. In an embodiment, as shown in FIGS. 6-9, the self-mailer 2 may be provided with a pocket 48 for receiving the article 52. The article 52 may be a document, such as, for example, a single-paged and/or a multi-paged document, a bi-folded document, a tri-folded document, an unfolded document, a check, one or more tickets, a form, an envelope and/or the like. The pocket 48 may be sized to receive, for example, an envelope, such as, for example, a standard #9 envelope and/or the like with or without multiple pages and/or items enclosed therein. The self-mailer 2 may be customized for use with various business or personal communications as needed. The present invention should not be deemed as limited to a specific embodiment of the correspondence 42 and/or the article 52. It should be understood that the correspondence 42 and/or the article 52 may be any correspondence 42 and/or article 52 that may require mailing by the special service as known to one having ordinary skill in the art.

Figure 3:
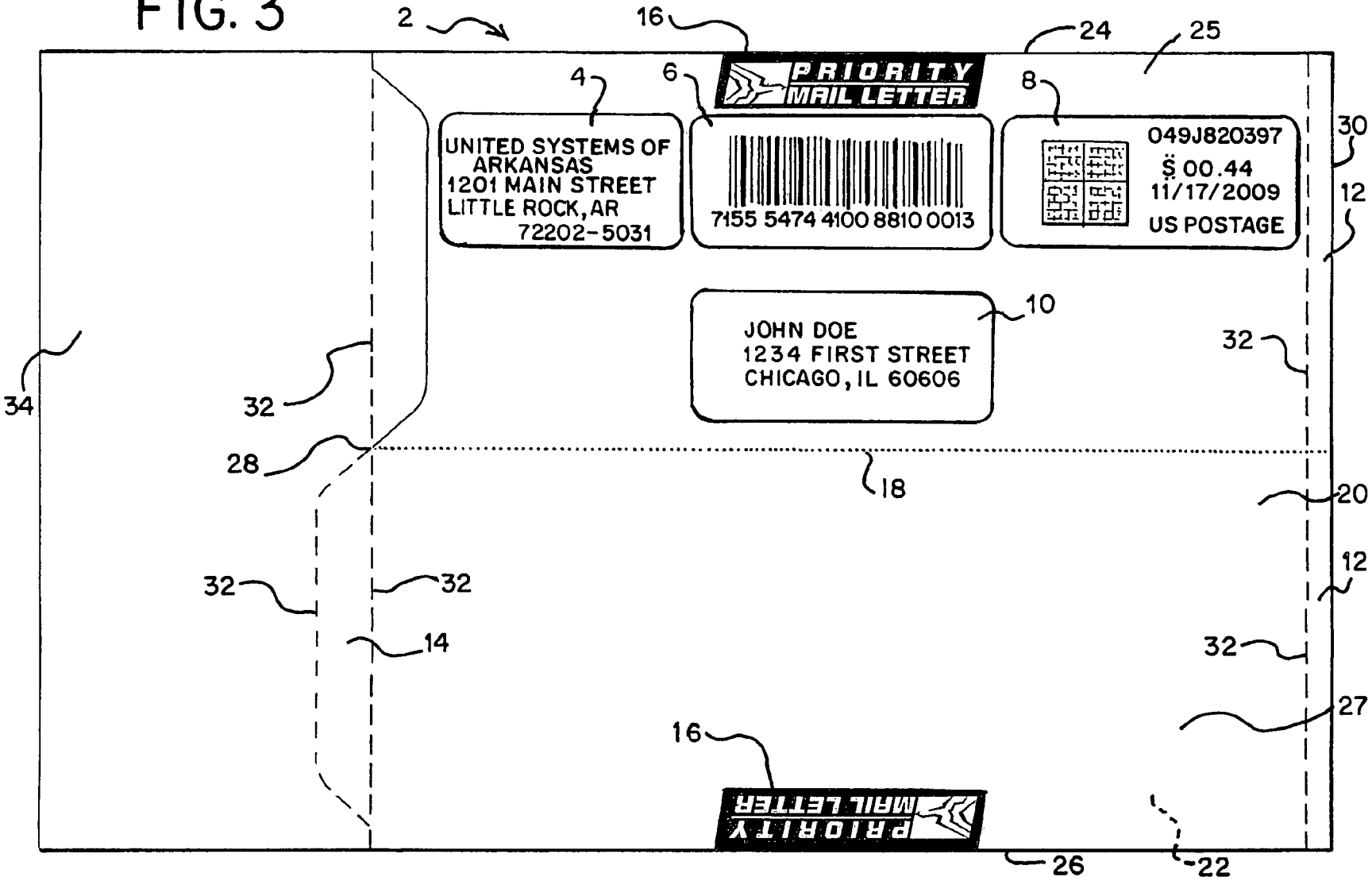
FIG. 3 illustrates a front plan view of a self-mailer for mailing correspondence and/or articles via a special service in an embodiment of the present invention.

As shown in FIG. 3, the unassembled self-mailer 2 may be generally rectangular in shape. The self-mailer 2 may have a thickness defined between a front side 20 and a rear side 22 that may be positioned opposite to the front side 20. The self-mailer 2 may have a height defined between a top end 24 and a bottom end 26 that may be positioned opposite to the top end 24. The self-mailer 2 may have a length defined between a first end 28 and a second end 30 that may be positioned opposite to the first end 28. The self-mailer 2 may be divided into a top panel 25 and a bottom panel 27 by a fold line 18. In an embodiment, as shown in FIG. 5, the self-mailer 2 may be provided with a blank space on the rear side 22 of the top panel 25 and/or on the rear side 22 of the bottom panel 27 for receiving correspondence 42. When assembling the self-mailer 2 for delivery, the self-mailer 2 may be folded at the fold line 18 to position the rear side 22 of the top panel 25 substantially adjacent to the rear side 22 of the bottom panel 27. The self-mailer 2 may be sealed at this position to obscure the correspondence 42 and/or to secure the article 52 during mailing via the special service.

As shown in FIGS. 3-9, the self-mailer 2 may have a detachable portion 34 that may extend from the first end 28 of the self-mailer 2. The detachable portion 34 may be separated from the first end 28 of the self-mailer 2 by a separation line 32, such as, for example, a linear perforation, a score line, one or more slits, one or more slots, a partial or incomplete tear and/or the like. The separation line 32 may allow a user to remove the detachable portion 34 before assembling the self-mailer 2 for delivery by the special service. As shown in FIGS. 6-9, the rear side 22 of the detachable portion 34 may be provided with one or more removable adhesive labels 40. The labels may be printed with, for example, a return address, a special service ID number, a unique article number, a barcode, postage, a mailing address, a receipt, a tracking number and/or the like. In an embodiment, the labels 40 may be printed when the labels 40 may be located on the rear side 22 of the detachable portion 34. A user of the self-mailer 2 may then remove the labels 40 having, for example, the return address, the special service ID, the unique article number, the barcode, the postage, the tracking number and/or the mailing address and/or may affix the labels 40 to the front side 20 of the top panel 25. However, it should be understood that the labels 40 may be printed with any information that the user may require.

As shown in FIGS. 1-4, the labels 40 may be peeled from the detachable portion 34 and placed, for example, at locations 2, 6, 8 and 10 on the front side 20 of the top panel 25. However, it should be understood that the return address, the special service ID with the barcode, the postage, the mailing address, the tracking number and/or any other information may be printed directly on the front side 20 of the top panel 25 if using the labels 40 may not be required. Further, information may be printed on the the front side 20 and the rear side 22 of the self-mailer 2 using any one or more of various printing methods, such as, for example, duplex printing and/or simplex printing.

Figure 4:
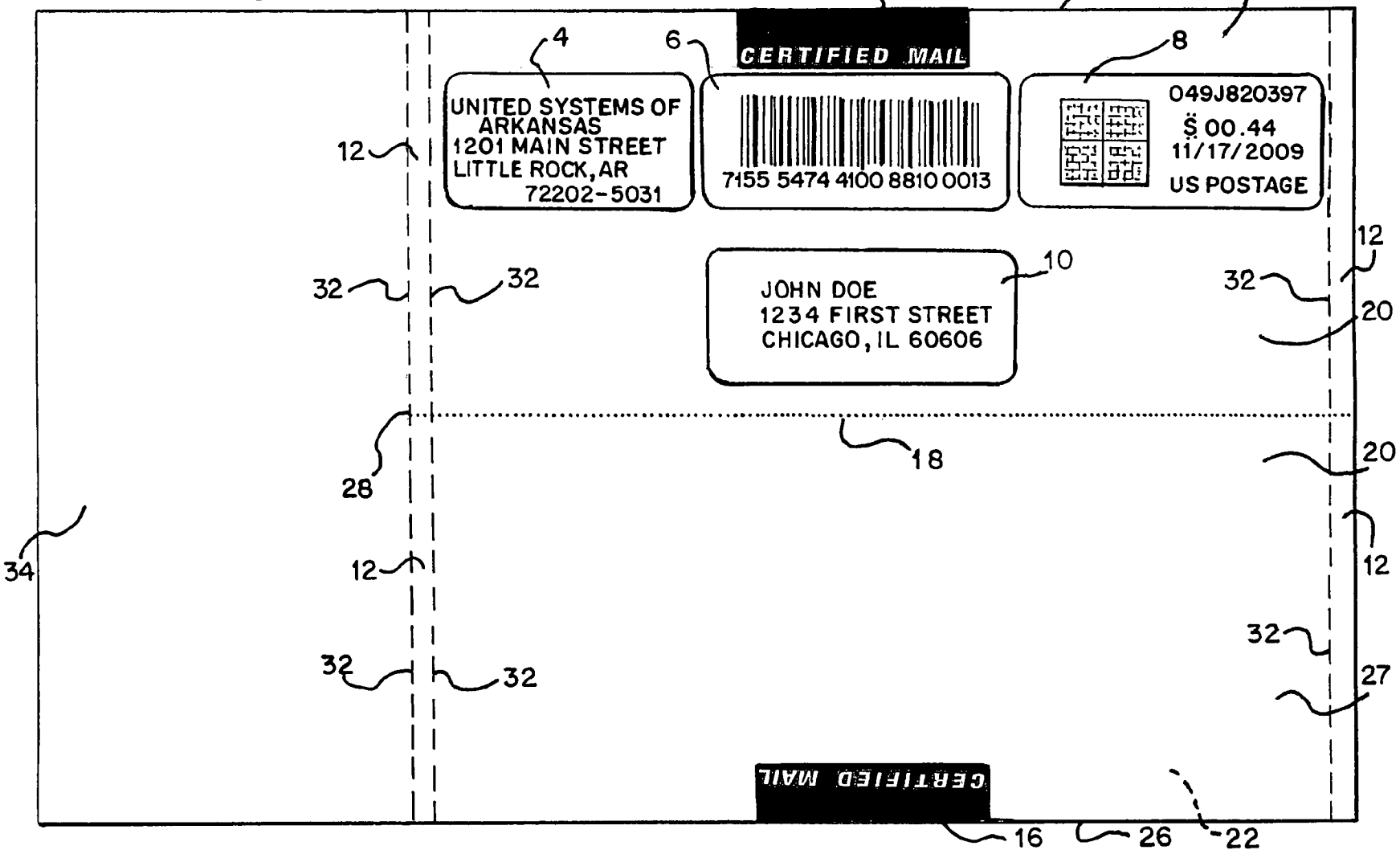
FIG. 4 illustrates a front plan view of a self-mailer for mailing correspondence and/or articles via a special service in an embodiment of the present invention.

In an embodiment, on the front side 20 of the self-mailer 2, the top end 24 and/or the bottom end 26 may be printed with indicia 16 that may be associated with the special service that may be used with the self-mailer 2. As shown in FIGS. 3 and 4, the indicia 16 that may be printed on the bottom panel 27 may be essentially identical to the indicia 16 printed on the top panel 25; however, the indicia 16 on the bottom panel 27 may be rotated, for example, 180 degrees relative to the indicia on the top panel 25 so that the indicia 16 on the bottom panel 27 presents vertically when the self-mailer is folded and assembled for mailing.

As shown in FIGS. 3-9, 12 and 13, the self-mailer 2 may have a separation strip 12 that may extend from both the top panel 25 and the bottom panel 27 at the second end 30 of the self-mailer 2. During assembly of the self-mailer 2 and after folding the self-mailer 2, the separation strip 12 of the top panel 25 may be fastened to the corresponding separation strip 12 of the bottom panel 27 between the rear side 22 of the top panel 25 and the rear side 22 of the bottom panel 27 as shown in FIGS. 1 and 2. The separation strips 12 may be separated from the self-mailer 2 using the separation line 32. A recipient of the assembled self mailer may open the second end 30 of the assembled self-mailer 2 by bending the separation strip 12 at the separation line 32 and tearing the separation strip 12 from the self-mailer 2 along the separation line 32. Removing the separation strip 12 at the second end 30 may provide the recipient with access to an interior of the assembled self-mailer 2 to allow the recipient to further open the self-mailer 2 at the top end 24 and/or the first end 28.

In an embodiment, as shown in FIGS. 3, 5, 6, 7 and 13, the self-mailer 2 may have a separation tab 14 that may extend from the bottom panel 27 at the first end 28 of the self-mailer 2. During assembly of the self-mailer 2 and after folding the self-mailer 2, the separation tab 14 may be folded and/or fastened to the front side 20 of the top panel 25 as shown in FIG. 1. The separation tab 14 may be separated from the self-mailer 2 using the separation line 32. A recipient of the assembled self mailer may open the first end 28 of the assembled self-mailer 2 by sliding, for example, a finger, a letter opener and/or the like between the top panel 25 and the bottom panel 27 to tear the separation line 32 at the first end 28. Tearing the separation line 32 at the first end 28 of the assembled self-mailer 2 may provide the recipient with access to the interior of the assembled self-mailer 2 to allow the recipient to further open the self-mailer 2 at the top end 24.

Figure 8:
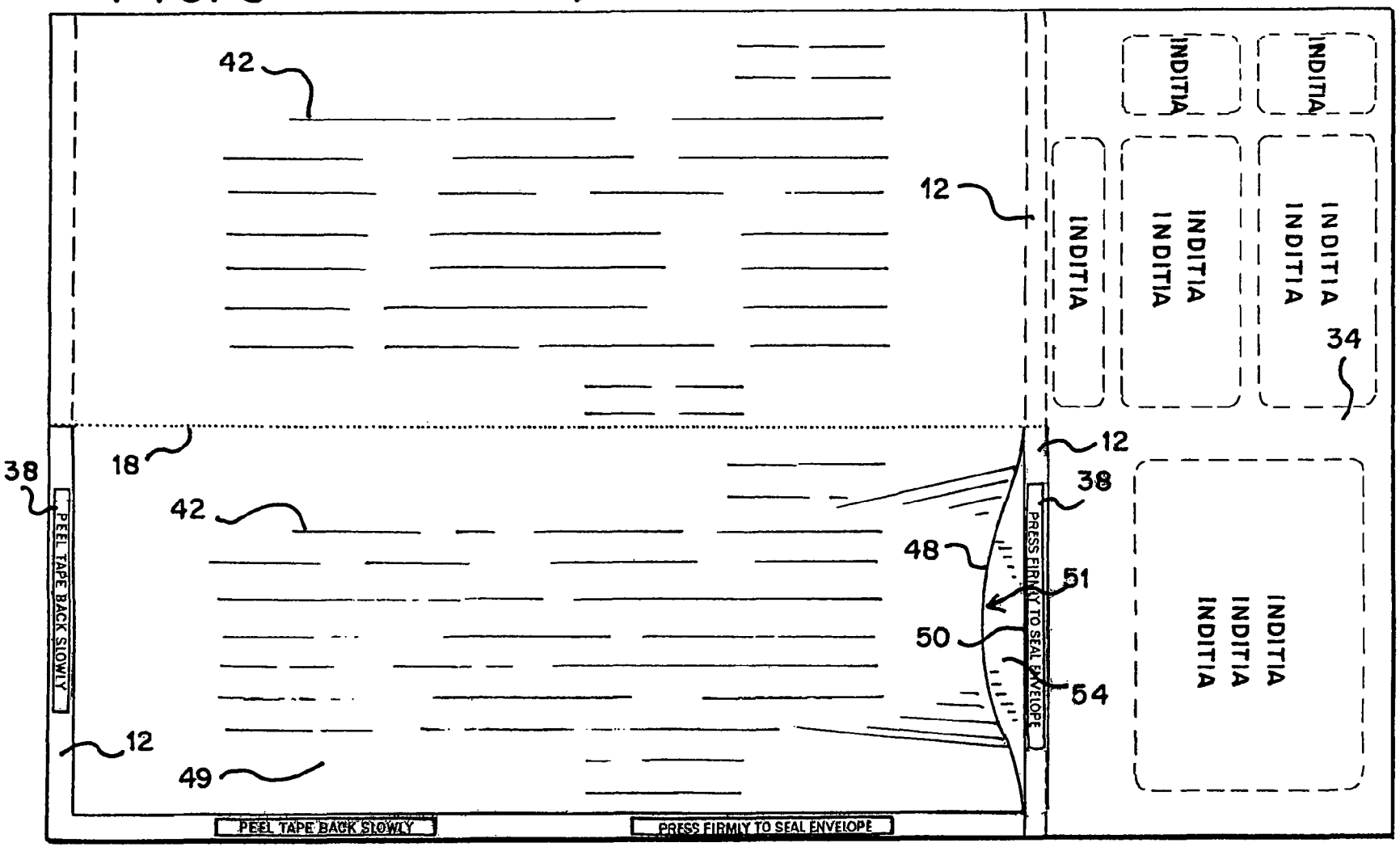
FIG. 8 illustrates a rear plan view of a self-mailer for mailing correspondence and/or articles via a special service in an embodiment of the present invention.

In an alternate embodiment, as shown in FIGS. 2, 4 and 8, the self-mailer 2 may have the separation strip 12 that may extend from both the top panel 25 and the bottom panel 27 at the first end 28 of the self-mailer 2. During assembly of the self-mailer 2 and after folding the self-mailer 2, the separation strip 12 at the first end 28 of the top panel 25 may be fastened to the corresponding separation strip 12 at the first end 28 of the bottom panel 27 between the rear side 22 of the top panel 25 and the rear side 22 of the bottom panel 27 as shown in FIG. 2. The separation strips 12 may be separated from the self-mailer 2 using the separation line 32. A recipient of the assembled self-mailer 2 may open the first end 28 of the assembled self-mailer 2 by bending the separation strip 12 at the separation line 32 and tearing the separation strip 12 from the self-mailer 2 along the separation line 32 at the first end 28. Removing the separation strip 12 at the first end 28 may provide the recipient with access to the interior of the assembled self-mailer 2 to allow the recipient to further open the self-mailer 2 at the top end 24.

Figure 13:
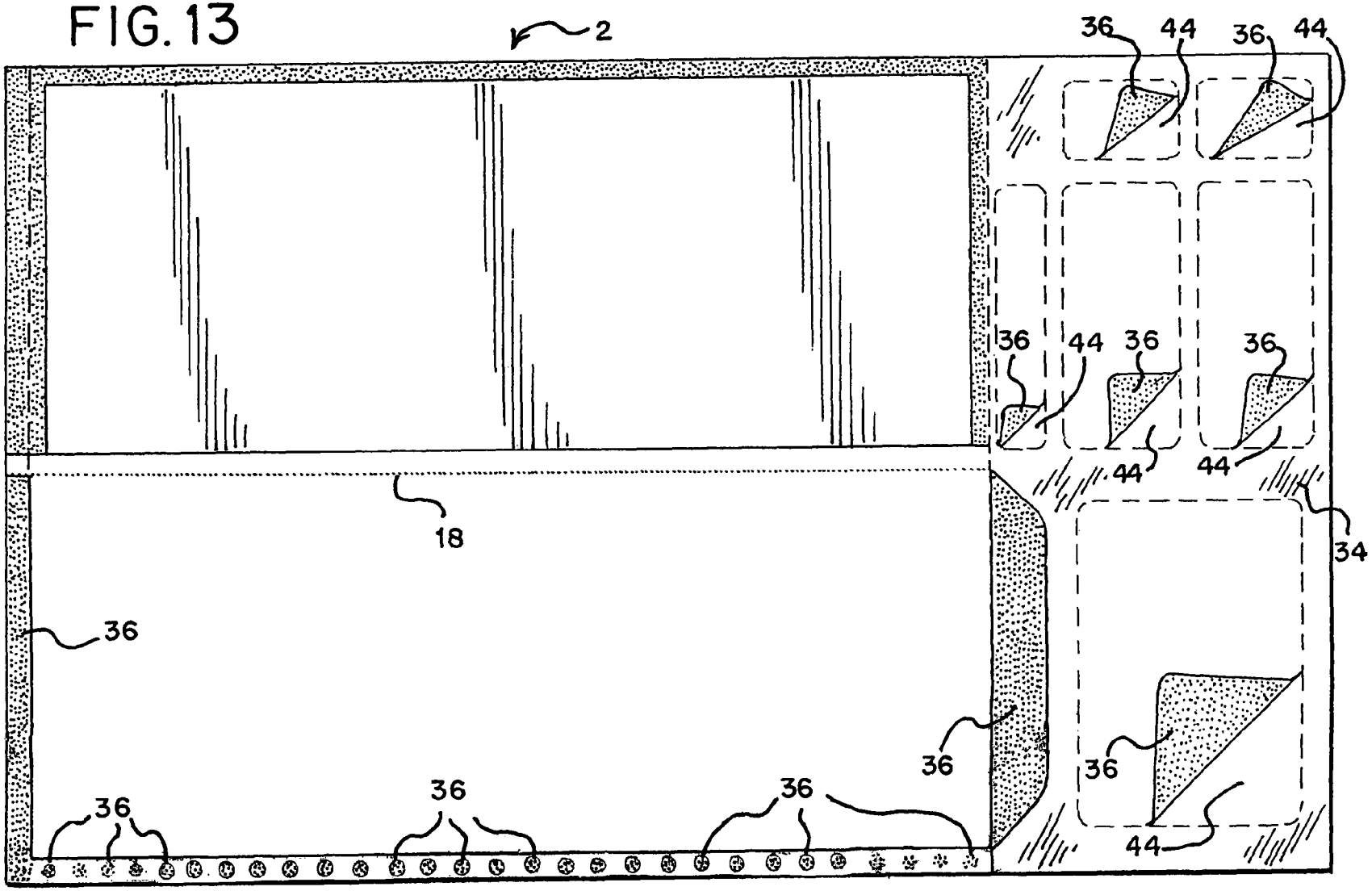
FIG. 13 illustrates a rear plan view of an adhesive layer of a self-mailer for mailing correspondence and/or articles via a special service in an embodiment of the present invention.

As shown in FIGS. 5, 6 and 13, on the rear side 22, the self-mailer 2 may be provided with the adhesive 36 in, for example, a non-continuous pattern along the bottom end 26 of the bottom panel 27. The non-continuous pattern may be, for example, dots of the adhesive 36 and/or any other pattern that increases the ability of the recipient to open the assembled self-mailer 2 without destroying the self-mailer 2, the correspondence 42 printed thereon and/or the article 52 provided therein. The adhesive 36 may be, for example, a permanent and/or a semi-permanent adhesive. During assembly of the self-mailer 2 and after folding the self-mailer 2, the top end 24 of the top panel 25 on the rear side 22 of the self-mailer 2 may be fastened correspondingly to the bottom end 26 of the bottom panel 27 on the rear side 22 of the self-mailer 2 as shown in FIGS. 1 and 2. The non-continuous pattern of the adhesive 36 may allow a recipient of the assembled self-mailer 2 to separate the top panel 25 from the bottom panel 27 by sliding, for example, a finger, a letter opener and/or the like between the top panel 25 and the bottom panel 27. The permanent and/or the semi-permanent nature of the adhesive 36 may allow a fiber tear to occur between the top panel 25 and the bottom panel 27 wherein, for example, a top layer of paper from either or both the top panel 25 and/or the bottom panel 27 may be torn from the respective panels and may remain affixed to the adhesive 36 after sliding an object between the two layers. A removal of portions of the top layers of paper may be indicative that a seal has been broken.

In an alternate embodiment, on the rear side 22, the self-mailer 2 may be provided with the adhesive 36 in, for example, a continuous pattern along the bottom end 26 of the bottom panel 27; however, the continuous pattern may allow the fiber tear to occur. The pattern of the adhesive 36 together with the permanent and/or semi-permanent nature of the adhesive 36 may prevent an unnoticed opening of the self-mailer 2 followed by a re-sealing of the self-mailer 2. The recipient may open the top end 24 of the assembled self-mailer 2; however, the recipient may determine if the self-mailer 2 has been opened or tampered with during delivery via the special service. Separating the top panel 25 from the bottom panel 27 at the top end 24 of the self-mailer 2 may provide the recipient with access to the interior of the assembled self-mailer 2 to allow the recipient to further open the self-mailer 2 at the first end 28 as shown in FIG. 1 and/or to open the self-mailer 2 to access the correspondence 42 and/or the article 52.

Figure 9:
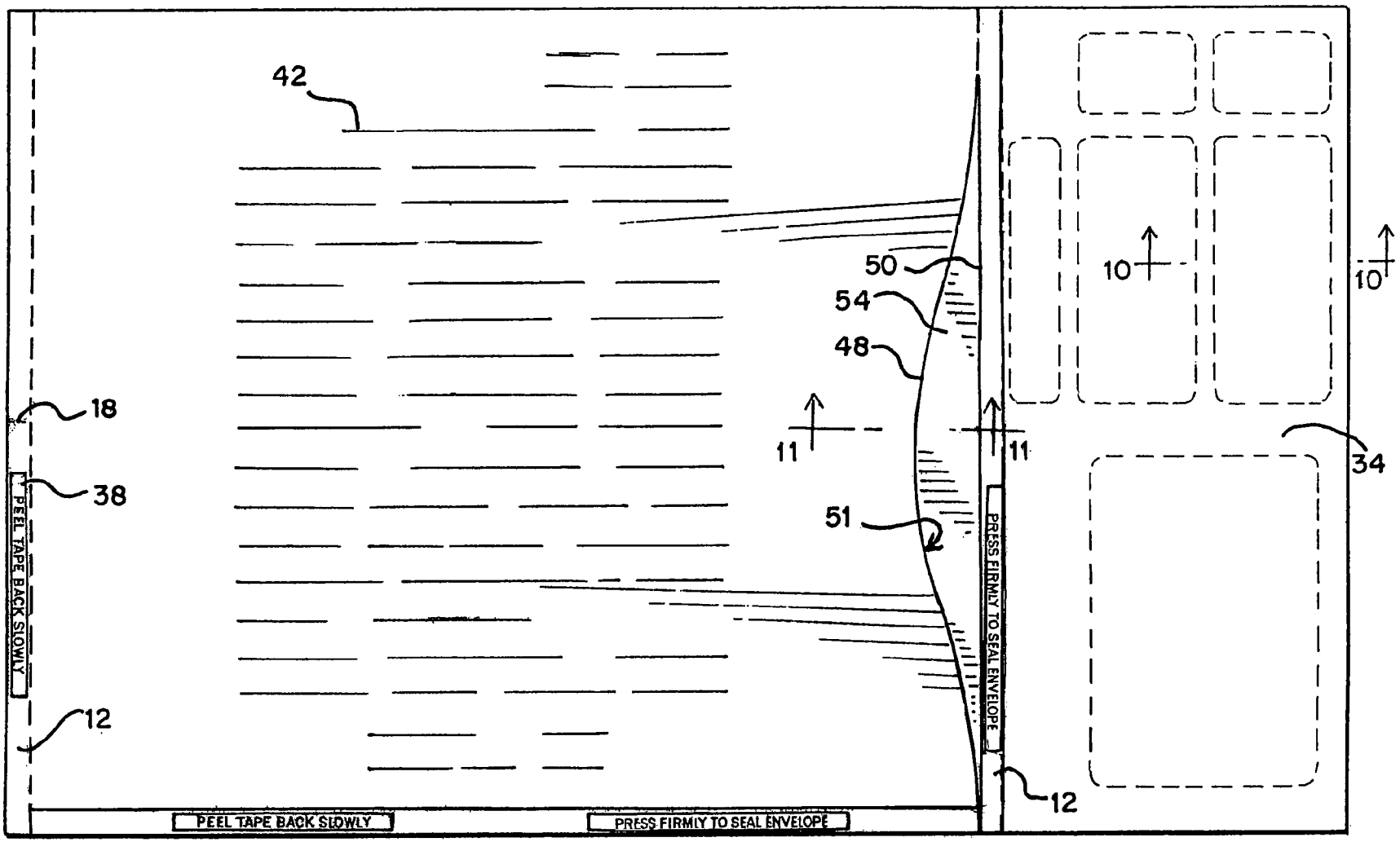
FIG. 9 illustrates a rear plan view of a self-mailer for mailing correspondence and/or articles via a special service in an embodiment of the present invention.
Figure 10:
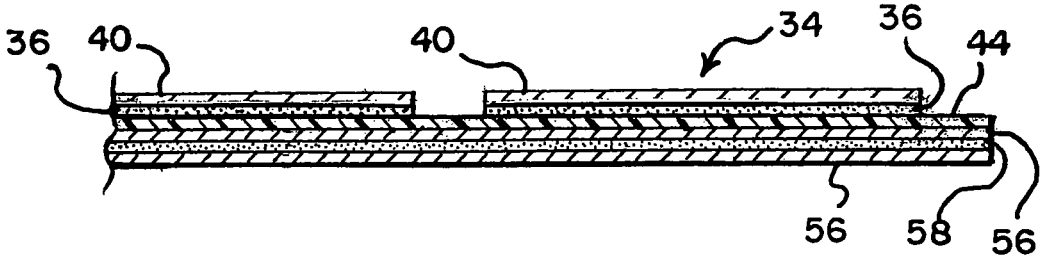
FIG. 10 illustrates a cross-sectional view taken along line 10-10 of FIG. 9 of a self-mailer for mailing correspondence and/or articles via a special service in an embodiment of the present invention.

The adhesive 36 that may be provided on the rear side 22 of the separation strips, the separation tab, the bottom end 26 of bottom panel 27 and/or on a back side of the removable labels 40 may be for example, a permanent or a semi-permanent adhesive. The adhesive 36 may be any adhesive for providing a permanent and/or a semi-permanent seal between layers of paper as known to a person having ordinary skill in the art. As shown in FIGS. 5-9, the self-mailer 2 may have release liners 38 that may cover the adhesive portions of the self-mailer 2. The release liners 38 may be peeled from the adhesive portions on the separation tab 14, the separation strips 12 and/or from the bottom end 26 of the bottom panel 27 on the rear side 22 of the self-mailer 2 to expose the adhesive 36 before folding and/or assembly of the self-mailer 2. As shown in FIGS. 5, 10 and 13, the rear side 22 of the detachable portion 34 may have a release layer 44, such as, for example, a silicone coating and/or the like that may allow the labels 40 to be removed from the detachable portion 34.

FIGS. 6-9 and 11 illustrate embodiments of the invention having the pocket 48 on the rear side 22 of the self-mailer 2. The pocket 48 may have a covering flap 49 affixed to the rear side 22 with the adhesive 36 at a perimeter of the covering flap 49. The perimeter of the covering flap 49 may have, for example four edges wherein, for example, at least three edges may be affixed to the rear side 22 of the self-mailer 2 as illustrated in FIG. 13. The pocket 48 may have an opening 51 for accessing a compartment that may be formed between the covering flap 49 and the rear side 22. In a preferred embodiment, the edge adjacent to the opening 51 may be closed and/or may be affixed to the rear side 22 until use by the sender. The edge adjacent to the opening of the covering flap 49 may be affixed to the rear side 22 by, for example, an adhesive, a glue, a binding agent and/or the like. The edge adjacent to the opening 51 of the covering flap 49 may be affixed to the rear side by, for example, heating, melting and/or cauterizing the covering flap 49 to the rear side 22 at the opening 51. The covering flap 49 may be affixed to the rear side 22 at the opening 51 by, for example, a non-permanent adhesive. The cover flap 49 may form a crack-and-peel backer liner. The cover flap 49 may be formed by a kiss cut. The user may bend the self-mailer 2 to detach the edge adjacent to the opening 51 of the covering flap 49 from the rear side 22 to open the pocket 48 for use. However, if the sender chooses not to use the pocket 48 when using the self-mailer 2, the user may leave the edge adjacent to the opening 51 of the covering flap 49 affixed to the rear side 22. Moreover, the user may print and/or may write the correspondence 42 on the covering flap 49.

Figure 12:
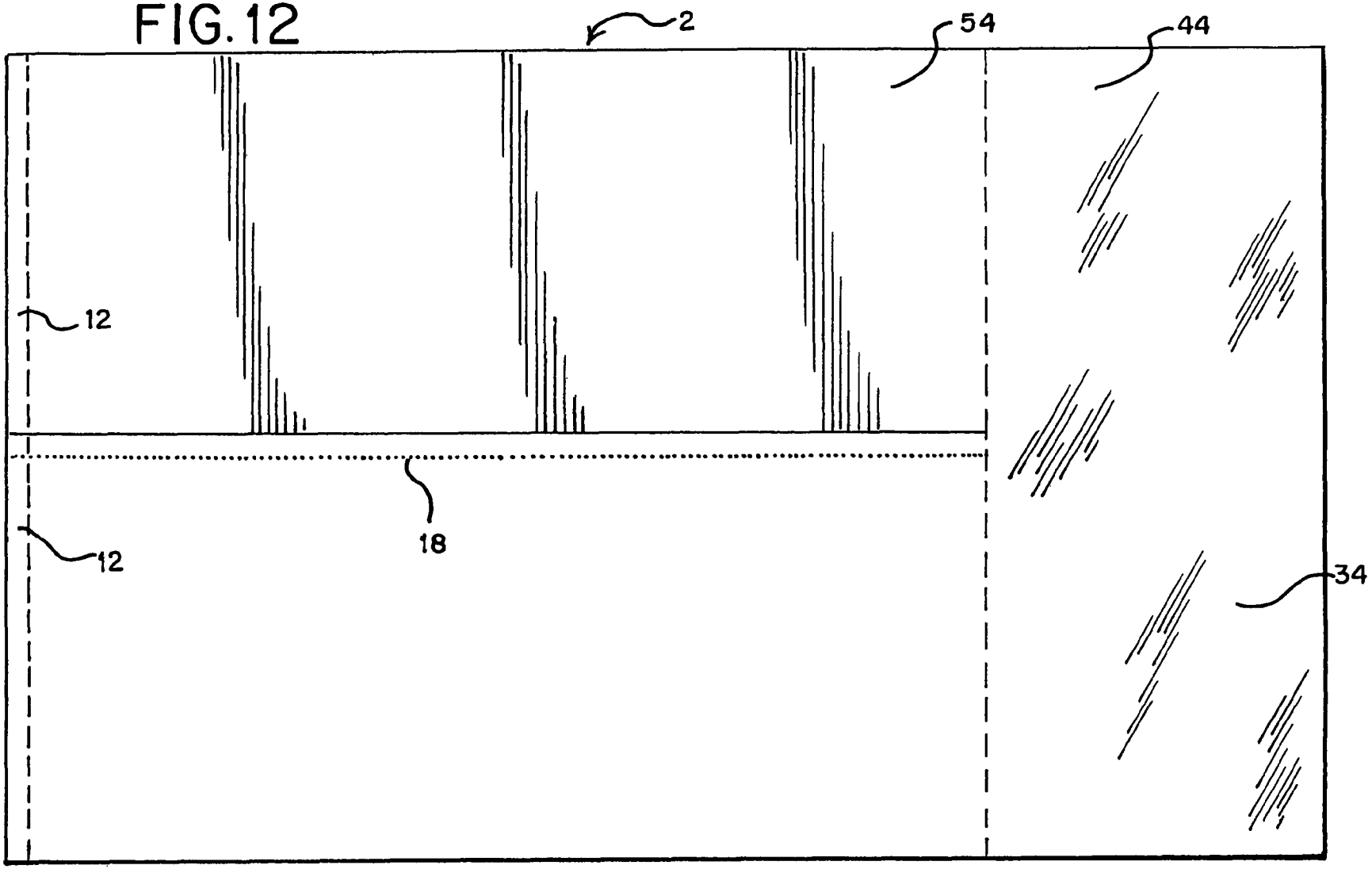
FIG. 12 illustrates a rear plan view of a base layer of a self-mailer for mailing correspondence and/or articles via a special service in an embodiment of the present invention.

In an embodiment, as shown in FIGS. 6 and 12, an inside of the pocket 48 may be printed with a security pattern 54 which may be, for example, a solid color, indicia, a mark and/or the like that may increase the opacity of the pocket 48 and/or the self-mailer 2 and/or that may obscure a viewing of the article 52 and/or the correspondence 42 when the self-mailer 2 is assembled. The present invention should not be deemed as limited to a particular embodiment of the security pattern 54. The security pattern 54 may be any printing, indicia, mark and/or the like known to a person having ordinary skill in the art.

Figure 7:
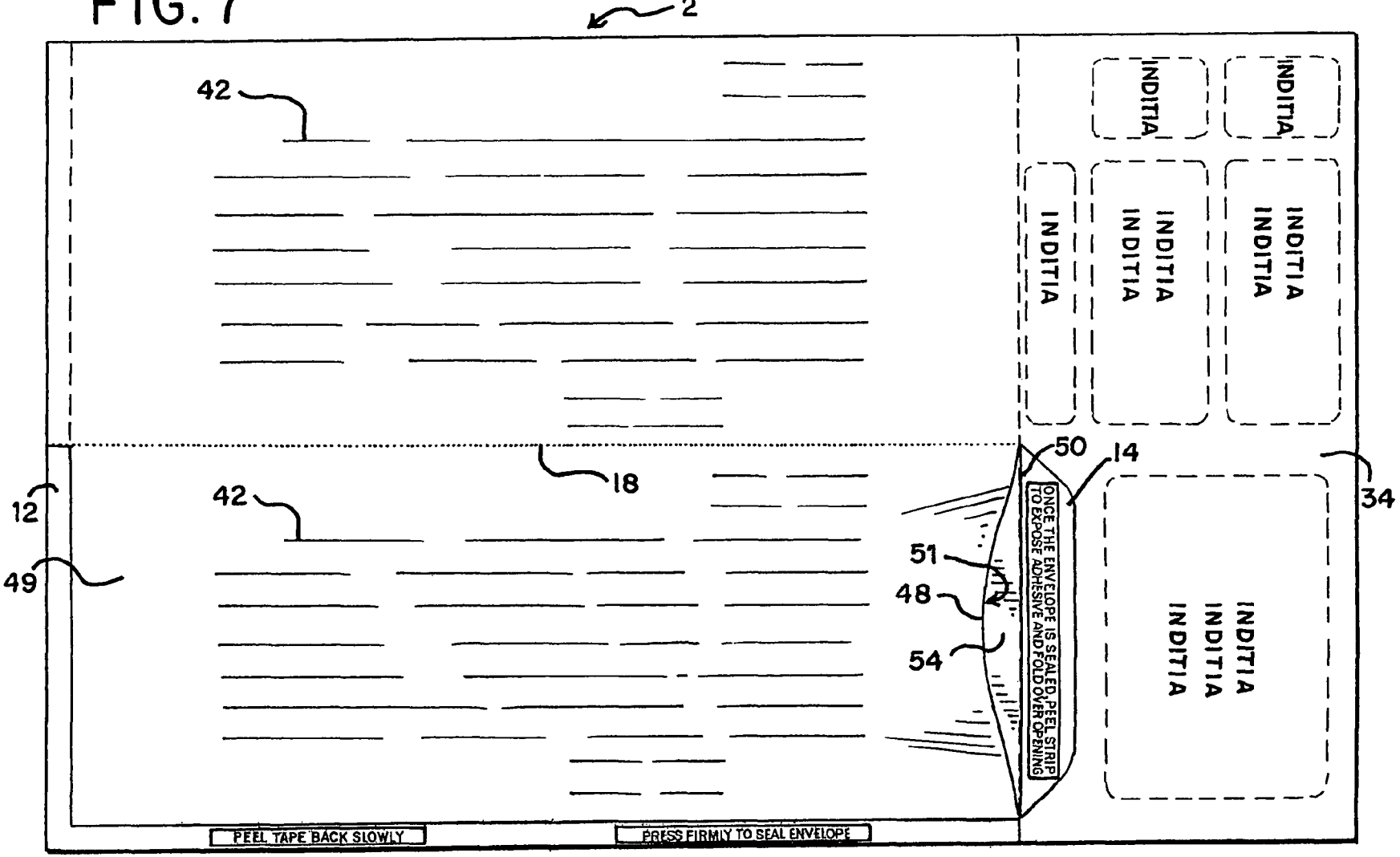
FIG. 7 illustrates a rear plan view of a self-mailer for mailing correspondence and/or articles via a special service in an embodiment of the present invention.

The pocket 48 may have various locations on the rear side 22 of the self-mailer 2. As shown in FIG. 6, the covering flap 49 may cover the rear side 22 of the top panel 25 and/or the opening 51 may be positioned adjacent to the fold line 18. As shown in FIGS. 7 and 8, the covering flap 49 may cover the rear side 22 of the bottom panel 27 and/or the opening 51 may be positioned adjacent to the first end 28 of the bottom panel 27. As shown in FIG. 9, the covering flap 49 may cover the rear side of both the top panel 25 and the bottom panel 27 and/or the opening 51 may be positioned adjacent to the first end 28 of both the top panel 25 and the bottom panel 27.

Figure 11:
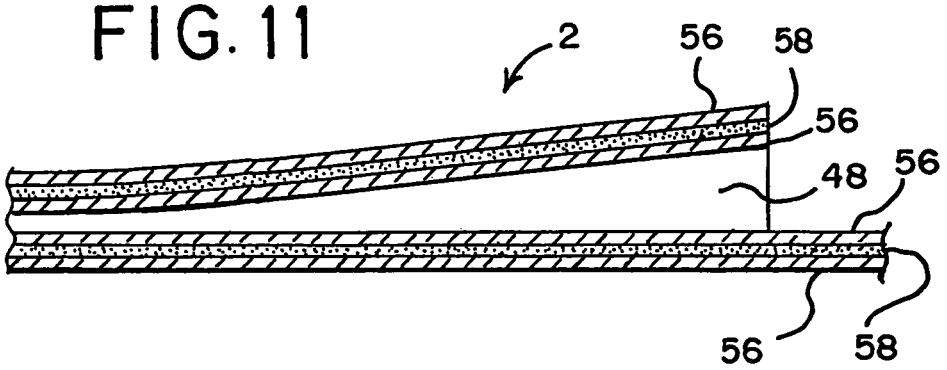
FIG. 11 illustrates a cross-sectional view taken along line 11-11 of FIG. 9 of a self-mailer for mailing correspondence and/or articles via a special service in an embodiment of the present invention.

FIG. 12 generally illustrates a base layer of the self-mailer 2. The self-mailer 2 may be constructed from a paper product, such as, for example, a laminated paper, a composite paper and/or the like as illustrated in FIGS. 10 and 11. In a preferred embodiment, the self-mailer 2 may be constructed from a composite paper having a first paper layer 56 that may be laminated to a second paper layer 56 with a binding layer 58, such as, for example, an adhesive, a glue, an epoxy, a resin, a binding agent and/or the like. Using a composite paper may increase a durability of the self-mailer 2. Further, after the adhesive 36 is bonded to the composite paper to form the sealed and assembled self-mailer 2, any tampering with the seal and/or any attempt to open the self-mailer 2 may result in fibers from the paper layer 56 being torn from the binding layer 58. Such fiber tearing may be obvious to the recipient of the self-mailer 2 and may be an indication that the self-mailer 2 was tampered with during delivery by the special service.

To use the self-mailer 2, the sender of the correspondence 42 and/or the article 52, may, for example, print a message on the rear side of the self-mailer 2 and/or on the covering flap 49 of the pocket 48. Further, the sender may print information, such as, for example, the return address, the postage, the mailing address and/or the like on the removable labels 40 of the detachable portion 34 and/or on the top panel 25 of the front side 20 of the self-mailer 2. The user may remove the printed labels 40 from the detachable portion 34 and/or may place the printed labels on the top panel 25 of the front side 20 to indicate, for example, the return address, the postage and/or the mailing address.

The special service ID label which may have, for example, the tracking number, the unique article ID and/or the barcode and may be, for example, pre-printed on the top panel 25 of the front side 20 of the self-mailer 2. The special service ID label may be associated with the special service selected by the sender. The postal carrier and/or the parcel carrier may scan or input the tracking number, the unique article ID and/or the barcode into a computer system for tracking the self-mailer 2. If the sender has not applied postage to the self-mailer 2, the postal carrier and/or the parcel carrier may sell postage to the sender and/or may apply postage to the self-mailer 2. The postal carrier and/or the parcel carrier may input the special service selected into the computer system and/or may provide the sender with a receipt of deposit. The receipt may be used by the sender to track the delivery of the self-mailer 2 via the special service. In an embodiment, the tracking number, the unique article ID and/or the bar code may be printed on one of the removable labels 40 and may be kept as a receipt by the sender with the detachable portion 34. The postage carrier and/or the parcel carrier may input and/or scan the tracking number, the unique article ID and/or the barcode into the computer system upon delivery to the recipient of the self-mailer 2. The sender may refer to the tracking number, the unique article ID and/or the a receipt on the label 40 to track the self-mailer 2 during and after delivery by the special service using, for example, a computer interface, a telephone interface and/or a website provided for the special service by the postage carrier and/or the parcel carrier.

The sender may select a self-mailer 2 having the pocket 48. The sender may bend the self-mailer 2 at the opening 51 in a direction towards the front side 20 of the self-mailer 2 to open the pocket 48. The sender may insert the articles 52 into the pocket 48. After the self-mailer 2 has been printed as desired and/or after the pocket 48 has been prepared as desired, the sender may remove the detachable portion 34 along the separation line 32. The sender may remove the release liners 38 from the rear side 22 of the bottom panel 27 to expose the adhesive 36. The sender may fold the top panel 25 at the fold line 18 towards the rear side 22 of the bottom panel 27 and may press the folded self-mailer 2 around the edges to ensure that the adhesive 36 is attached to the rear side 22 of the top panel 25. In an embodiment having the separation tab 14, the sender may fold the separation tab and press to seal the separation tab 14 to the front side 20 of the top panel 25. The sender may then deposit the assembled self-mailer 2 with the postal carrier or the parcel carrier as discussed above.

After delivery of the assembled self-mailer 2 via the special service, the recipient may open the self mailer 2 in a variety of ways depending on which self-mailer 2 is used. In the embodiment having the separation tab 14 at the first end 28 of the self-mailer 2, the recipient may bend, tear and/or remove the separation strip along the separation line 32 at the second end 30 of the assembled self-mailer 2. The recipient may slide, for example, a finger between the top panel 25 and the bottom panel 27 at the top end 24 of the self-mailer to break the seal at the top end 24. The recipient may then pull the top panel 25 in a direction away from the bottom panel 27 at the first end 28 to tear the separation tab 14 along the separation line 32. The recipient may then unfold the self-mailer 2 and may review the correspondence 42 and/or the articles 52 in the pocket 48.

In the embodiment having the separation strip 12 at the first end 28 and at the second end 30 of the self-mailer 2, the recipient may bend, tear and/or remove the separation strip 12 along the separation line 32 at either the first end 28 or at the second end of the assembled self-mailer 2. The recipient may then bend/tear and/or remove the separation strip 12 at the opposite end. The recipient may slide, for example, a finger between the top panel 25 and the bottom panel 27 at the top end 24 of the self-mailer to break the seal at the top end 24. The recipient may then unfold the self-mailer 2 and may review the correspondence 42 and/or the articles 52 in the pocket 48. The expended self-mailer 2 may be kept, disposed of and/or recycled by the recipient after delivery via the special service.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A self-mailer for delivery via a special service, the self-mailer comprising:

a generally rectangular sheet having a width defined between a front side and a rear side wherein the rear side is positioned opposite to the front side wherein the sheet has a height defined between a top end and a bottom end wherein the bottom end is positioned opposite to the top end wherein the sheet has a length defined between a first end and a second end wherein the second end is positioned opposite to the first end wherein the sheet is divided into a top panel and a bottom panel by a fold line that extends between the first end of the sheet and the second end of the sheet wherein the front side has indicia indicative of the special service wherein the indicia specify a particular special service manner of delivery of the self-mailer wherein the particular special service manner of delivery requires handling of the self-mailer in accordance with special service requirements specified by the indicia and further wherein the indicia have an article number for tracking delivery via the special service;

a flap affixed to the rear side wherein the flap defines a pocket between the rear side and the flap;

a detachable portion at the first end of the sheet wherein the detachable portion extends between the top end of the sheet and the bottom end of the sheet wherein the detachable portion is located external to the top panel and the bottom panel and further wherein the detachable portion is separable from the top panel and the bottom panel such that the detachable portion may be removed from the sheet without removing a portion of the top panel and the bottom panel;

a tab extending from the bottom panel at the first end between the detachable portion and the bottom panel wherein the entirety of the tab is positioned between the detachable portion and the bottom panel wherein the tab attaches to the top panel on the front side;

a label located on the detachable portion to accommodate one-sided printing of the self-mailer wherein the label separates from the detachable portion and attaches to the front side;

a first separation strip at the second end of the sheet wherein the first separation strip extends between the top end of the sheet and the bottom end of the sheet; and an adhesive on the first separation strip on the rear side of the sheet and at the bottom end on the rear side of the sheet wherein the rear side of the top panel is attachable to the rear side of the bottom panel with the adhesive.

2. The self-mailer of claim 1 further comprising:

a separation line between the detachable portion and the first end of the sheet wherein the separation line is located at a peripheral edge of the top panel and the bottom panel wherein the detachable portion is removable from the first end of the sheet at the separation line without removing a portion of the top panel and the bottom panel.

3. The self-mailer of claim 1 further comprising:

a separation line between the first separation strip and the second end of the sheet wherein the first separation strip is removable from the second end of the sheet at the separation line.

4. The self-mailer of claim 1 further comprising:

a second separation strip at the first end of the sheet wherein the second separation strip extends between the top end of the sheet and the bottom end of the sheet wherein the second separation strip is positioned between the detachable portion, the top panel and the bottom panel.

5. The self-mailer of claim 1 further comprising:

a flap attached to the rear side of the sheet to form a pocket between the flap and the rear side of the sheet.

6. The self-mailer of claim 1 further comprising:

a liner on the adhesive wherein the liner is removable from the adhesive.

7. The self-mailer of claim 1 wherein the sheet is a laminated paper product.

8. The self-mailer of claim 1 wherein the adhesive provides a bond between the top panel of the sheet and the bottom panel of the sheet.

9. The self-mailer of claim 1 wherein the adhesive is applied in a pattern to the sheet to form a discontinuous layer of the adhesive wherein the discontinuous layer extends from the first end to the second end.

10. The self-mailer of claim 1 further comprising:

a release layer on the detachable portion wherein the release layer is a silicone coating.

11. A mailer for mailing correspondence requiring delivery by a special service wherein delivery by the special service requires a display of indicia related to delivery by the special service on an outside surface of the mailer, the mailer comprising:

a postal form having a first end and a second end wherein the second end is positioned opposite to the first end wherein the postal form has a first side and a second side wherein the second side is positioned opposite to the first side wherein the correspondence and the indicia related to the delivery by the special service are displayable on the second side of the postal form wherein the indicia specifies a particular special service manner of delivery of the mailer wherein the particular special service manner of delivery requires handling of the mailer in accordance with special service requirements specified by the indicia wherein the indicia has an article number for tracking delivery via the special service and further wherein the postal form has a top panel and a bottom panel divided by a fold line wherein the postal form folds at the fold line to position the second side of the top panel substantially adjacent to the second side of the bottom panel;

a blank area on the second side of the postal form to receive the correspondence thereon wherein the correspondence is obscured when the postal form folds at the fold line to position the second side of the top panel substantially adjacent to the second side of the bottom panel;

a cover affixed to the second side wherein the cover defines an interior space between the second side and the cover;

a detachable portion with a first side and a second side wherein the detachable portion extends from the top panel and the bottom panel wherein the detachable portion is located external to the top panel and the bottom panel and further wherein the detachable portion is separable from the top panel and the bottom panel such that the detachable portion may be removed from the sheet without removing a portion of the top panel and the bottom panel;

an adhesive label adhered to first side of the detachable portion to allow for single-sided printing of the indicia on the first side of the postal form wherein the adhesive label is removable and adheres at a position on the second side of the postal form according to the special service manner of delivery specified by the indicia;

adhesive labels on the detachable portion on the second side of the postal form wherein the adhesive labels are removable from the second side of the postal form for attachment to the first side of the postal form;

an adhesive on the second side of the postal form to affix the bottom panel to the top panel; and a separation line on the postal form at the first end and the second end to open the postal form.

12. The mailer of claim 11 further comprising:

a pocket on the second side of the postal form.

13. The mailer of claim 11 wherein the separation line is a linear perforation.

* * * * *